US006478155B2

(12) United States Patent
Bunyan

(10) Patent No.: US 6,478,155 B2
(45) Date of Patent: Nov. 12, 2002

(54) CAP-MOUNTED PILL CONTAINER

(76) Inventor: Kimberly Ann Bunyan, 7124 Backer Ct., Elk Grove, CA (US) 95758

( * ) Notice: Subject to any disclaimer, the term of this patent is extended or adjusted under 35 U.S.C. 154(b) by 0 days.

(21) Appl. No.: 09/819,257

(22) Filed: Mar. 27, 2001

(65) Prior Publication Data

US 2002/0139709 A1 Oct. 3, 2002

(51) Int. Cl.[7] ..... B65D 83/04; B65D 51/28

(52) U.S. Cl. ..... 206/538; 215/6; 215/228; 220/522

(58) Field of Search ..... 206/528, 532, 206/536, 538–540, 219–222; 215/228; 220/521, 522

(56) References Cited

U.S. PATENT DOCUMENTS 3,027,000 A * 3/1962 Kantrow ..... 206/536
3,433,378 A * 3/1969 Ross ..... 215/228
3,446,179 A * 5/1969 Bender ..... 206/534
4,475,654 A * 10/1984 Fruchter ..... 206/538
4,634,011 A * 1/1987 Polyblank ..... 215/6
5,850,919 A * 12/1998 Freed ..... 206/534

* cited by examiner

*Primary Examiner*—Bryon P. Gehman
(74) *Attorney, Agent, or Firm*—Risto A. Rinne, Jr.

(57) ABSTRACT

An apparatus for containing pills includes a cylindrically shaped portion that is adapted for attachment by the use of an adhesive to the underside of a cap for a prescription bottle and, once attached, for insertion into the prescription bottle. The cylindrically shaped portion includes an upper end and an opposite bottom end. The upper-end is attached to the cap and it includes the adhesive that is exposed by peeling off a protective covering and then applying the upper end to the cap. The upper end may include a first half of a hook and loop fastener with a second half of a hook and loop fastener attached to the inside of the cap to permit detachably attaching the upper end to the cap.

6 Claims, 1 Drawing Sheet

CAP-MOUNTED PILL CONTAINER

BACKGROUND OF THE INVENTION

1. Field of the Invention

The present invention, in general relates to containers for prescription medications and, more particularly, to a pill container attached to a cap of a prescription bottle.

People often are required to consume a half of a pill and must break medications in half. These "half-pills" often become lost in the prescription bottle that is obtained from the pharmacy and are difficult to extract when needed.

Also people sometimes take various combinations of pills and other types of medications at the same time. It is desirable to be able to carry those various other pills conveniently along with the main medications.

While various containers having a plurality of compartments are known, they are larger than is desired and they also cost additional funds.

When a pill type of a prescription is filled at a pharmacy it is almost always placed in a plastic prescription bottle by the pharmacist.

Typically these prescription bottles are well known types of containers that are often amber in color but may also be clear or include other shades. They come in a few standard sizes and their use is widespread.

As such these prescriptions bottles incur no additional cost to the user. All of these prescription bottles have removable caps.

Ideally, a solution would allow retrofitting to existing caps that are being used or which have already been sold.

Accordingly there exists today a need for a device that economically allows prescription bottles to separately contain half-pills or other types of pills.

Clearly, such an apparatus would be a useful and desirable device.

2. Description of Prior Art

Pill containers are, in general, known. For example, the following patents describe various types of these devices:

U.S. Pat. No. 6,164,471 to Kassouni, Dec. 26, 2000;

U.S. Pat. No. 6,089,180 to Nichols, Jr. Jul. 8, 2000;

U.S. Pat. No. 6,036,017 to Bayliss, IV, Mar. 14, 2000;

U.S. Pat. No. 5,850,919 to Freed, Dec. 22, 1998;

U.S. Pat. No. 4,887,755 to Gibilisco, Dec. 19, 1989;

U.S. Pat. No. 4,634,011 to Polyblank, Jan. 6, 1987;

U.S. Pat. No. 4,475,654 to Fruchter, Oct. 9, 1984;

U.S. Pat. No. 3,446,179 to Bender, May 27, 1969;

U.S. Pat. No. 3,433,378 to Ross, Mar. 18, 1969;

U.S. Pat. No. 3,367,484 to Nelson, Feb. 6, 1968;

U.S. Pat. No. 2,766,796 to Tupper, Oct. 16, 1956;

U.S. Design Pat. No. 427,906 to Carter, Jul. 11, 2000;

U.S. Design Pat. No. 316,039 to Sykes et al., Apr. 9, 1991; and

U.S. Design Pat. No. 279,651 to Freeman, Jul. 16, 1985.

While the structural arrangements of the above described devices, at first appearance, have similarities with the present invention, they differ in material respects. These differences, which will be described in more detail hereinafter, are essential for the effective use of the invention and which admit of the advantages that are not available with the prior devices.

OBJECTS AND SUMMARY OF THE INVENTION

It is an object of the present invention to provide a cap-mounted pill container that includes a second receptacle that attaches to a cap of a prescription bottle and which can contain a quantity of pills therein.

It is also an important object of the invention to provide a cap-mounted pill container that includes a second receptacle that attaches to a cap of a prescription bottle by the use of an adhesive and which can contain a quantity of pills therein.

Another object of the invention is to provide a cap-mounted pill container that includes a second receptacle that attaches to a cap of a prescription bottle by an adhesive that is exposed by peeling off a covering and which can contain a quantity of pills therein.

Still another object of the invention is to provide a cap-mounted pill container that can be used to contain half-pills therein.

Still yet another object of the invention is to provide a cap-mounted pill container that includes an opening for access therein, the opening being accessible when the cap is removed from a prescription bottle and inaccessible when the cap is attached to the prescription bottle.

Yet another important object of the invention is to provide a cap-mounted pill container that cannot be attached to a prescription bottle when the cap-mounted pill container is in an open position.

Still yet another important object of the invention is to provide a cap-mounted pill container that, according to an alternate embodiment, can be formed integrally with new caps for prescription bottles.

Still yet one further important object of the invention is to provide a cap-mounted pill container that that allows the cap-mounted pill container to be reused.

Briefly, a cap-mounted pill container apparatus for use with a prescription bottle that is constructed in accordance with the principles of the present invention has a second smaller container that is adapted to attach to the inside surface of a prescription bottle cap by use of an adhesive. The smaller container includes an outside diameter that is less than the inside diameter of the prescription bottle and it includes an opening therein that is disposed on a bottom end of the smaller container. Preferably, when the opening is placed in an open position, the opening renders a portion of the diameter of the smaller container larger than that of the inside of the prescription bottle and therefore the cap cannot be placed on the bottle. This prevents the contents of the smaller container from spilling out. According to an alternate embodiment, the smaller container is formed integrally with the cap.

DETAILED DESCRIPTION OF THE INVENTION

Figure 1:
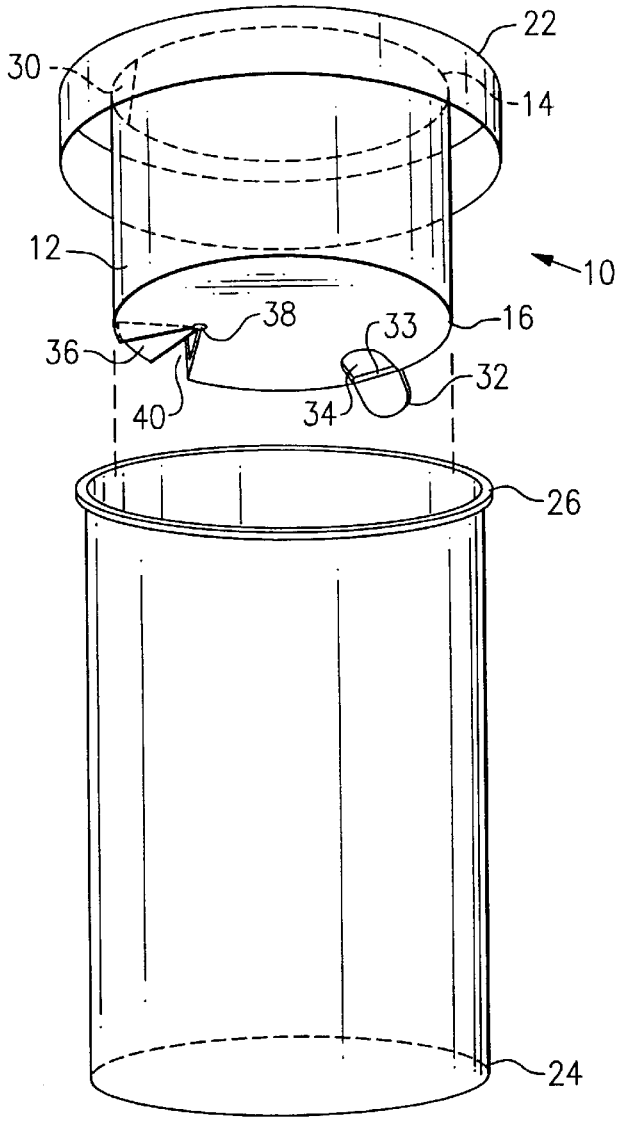
FIG. 1 is an exploded view in perspective of the cap-mounted pill container attached to a cap that is disposed above a prescription bottle.
Figure 2:
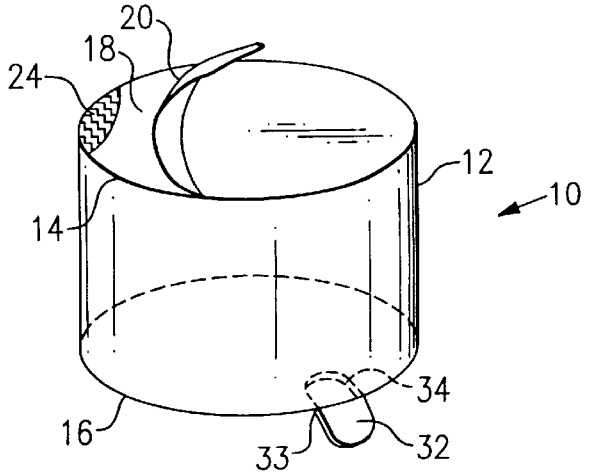
FIG. 2 is a view in perspective of the cap-mounted pill container before it is attached to the prescription bottle.

Referring to FIG. 1 and to FIG. 2 is shown, a cap-mounted pill container, identified in general by the reference numeral 10.

The cap-mounted pill container 10 includes a main body that includes a smaller container 12.

The smaller container 12 is cylindrical in shape. It includes an upper end 14 and a bottom end 16. The upper end 14 includes an adhesive 18 that is applied throughout its surface.

A peelable covering 20 is preferably used to protect the adhesive 18 until it is needed for use. The peelable covering 20 is then removed (i.e., it is peeled off of the upper end 14) and the upper end 14 is then aligned with the center of a cap 22 and is pressed to the inside of the cap 22.

This allows attachment of the cap-mounted pill container 10 to any cap 22 by a user (not shown). As such the cap-mounted pill container 10 may be sold as an accessory for use with the cap 22 and with any corresponding prescription bottle 24.

The smaller container 12 includes an outside diameter that is less than the inside diameter of the prescription bottle 24. Therefore when the cap 22 is placed on the prescription bottle 24, the smaller container 12 is placed in through an open end 26 of the prescription bottle 24.

The cap 22 then functions normally to close off the open end 26 of the prescription bottle 24 with the smaller container 12 being disposed in the prescription bottle 24.

Any acceptable glue or pre-applied adhesive may be used for the adhesive 18 that is used to attach the cap-mounted pill container 10 to the cap 22.

If desired, the adhesive 18 may include both halves of a hook and a loop fastener, shown respectively as a first half 28 (only a portion of what is normally used is shown) that is attached to the cap-mounted pill container 10 and a second half 30 (only a portion of what is normally used is shown) that is attached (i.e., adhered) to the inside of the cap 22. A well known brand of hook and loop fastener is marketed under the tradename of VELCRO.

The use of a the hook and loop fastener allows for the cap-mounted pill container 10 to be attached to the cap 22, when desired, and removed therefrom when desired. Accordingly, if another segment (not shown) of the second half 30 of the hook and loop fastener is attached to a second cap (not shown), the cap-mounted pill container 10 can be reused with other the second (or other) caps. Accordingly, its use is extended indefinitely.

The bottom end 16 of the smaller container 12 includes means for accessing into the volume (i.e., space) that is within the smaller container 12. This volume is normally used to house a number of "half-pills" (not shown)—or any other type of a pill (not shown) or pills as may be desired.

Two means for accessing inside the smaller container 12 are shown. The first and preferable means includes a hingedly attached segment 32 that fits tightly into a correspondingly shaped opening 34 that is formed in the bottom end 16 of the smaller container 12.

The hingedly attached segment 32 is adapted to pivot about an axis defined by a hinge 33 between a first closed position and a second open position.

When the hingedly attached segment 32 is closed, it forms an effective seal to keep the contents (i.e., half-pills, etc.) that have been placed in the smaller container 12 therein.

When the hingedly attached segment 32 is fully opened, it effectively increases the inside diameter of the smaller container 12 to an amount that exceeds the inside diameter of the prescription bottle 24.

This is preferred because it prevents attaching the cap 22 (and the cap-mounted pill container 10) to the prescription bottle 24. This, in turn, ensures that the contents in the smaller container 12 cannot fall out of the smaller container 12 and mingle with the contents of the prescription bottle 24.

This is no minor point. If the contents were to mingle (i.e., to mix together) it is possible that a person taking a dose of critical medicine from the prescription bottle 24 might wrongly consume the contents that were previously in the smaller container 12.

In a worst-case scenario, this could prove deadly. Obviously, when the same medicine (half-pills, for example) that are placed in the smaller container 12 are also placed in the prescription bottle 24 this problem is lessened and only an error in magnitude of dosing is likely to occur. This still poses a problem for less competent patients (i.e., users) and is to be avoided as well.

That is why ensuring that the cap 22 cannot be placed on the prescription bottle 24 when the smaller container 12 is open is a desirable feature.

An alternate way of providing access to the smaller container 12 may be provided by a pivoting segment 36 that pivots in an arc around a pin 38 that is attached to the bottom end 16.

The pivoting segment 36 may be pivoted to expose a pie-shaped opening 40 to place or remove contents from the smaller container 12 or it may be pivoted to cover the pie-shaped opening 40 and secure the contents therein.

According to an alternative embodiment, the smaller container 12 may be integrally formed with the cap 22 during manufacture of the cap 22.

The invention has been shown, described, and illustrated in substantial detail with reference to the presently preferred embodiment. It will be understood by those skilled in this art that other and further changes and modifications may be made without departing from the spirit and scope of the invention which is defined by the claims appended hereto.

What is claimed is:

1. A cap-mounted pill container that is adapted for use with a prescription bottle, comprising:

(a) a smaller container portion that is cylindrical in shape and which includes an outside diameter that is less than the inside diameter of the prescription bottle and including an upper end and an opposite bottom end;

(b) means for attaching said upper end of said smaller container portion to the cap; and (c) means for providing an opening into said smaller container portion, said means attached to the bottom end;

wherein said means for providing an opening includes a first segment that is hingedly attached to said smaller container, said first segment being adapted to pivot about a hinge into a first closed position in which said first segment is adapted to fit into a correspondingly shaped first opening in said bottom end of said smaller container and wherein said first segment is adapted to pivot about said hinge into a second open position in which access into said smaller container is provided.

2. The cap-mounted pill container of claim 1 wherein said means for attaching includes an adhesive.

3. The cap-mounted pill container of claim 2 wherein said adhesive includes a peelable covering disposed over said adhesive, said adhesive being exposed subsequent to removing said peelable covering apart from said upper end of said cap-mounted pill container.

4. The cap-mounted pill container of claim 1 wherein the outer diameter of a portion of said smaller container portion exceeds the inside diameter of the prescription bottle when said first segment is pivoted into said second open position.

5. The cap-mounted pill container of claim 1 wherein said means for providing an opening includes a second segment that includes a substantially triangular shape with two adjacent legs thereof that meet at a center point and diverge therefrom for a predetermined distance and an arcuate portion that connects each of said two adjacent legs at an end opposite where said two adjacent legs meet at said center point and wherein said substantially triangular shape is adapted to pivot about a pin between a first closed position that covers a correspondingly shaped opening and a second open position that exposes said opening.

6. The cap-mounted pill container of claim 1 wherein said means for attaching includes forming said cap-mounted pill container as an integral part of the cap.

* * * * *